United States Patent [19]

Jacoby et al.

[11] Patent Number: 4,628,985

[45] Date of Patent: Dec. 16, 1986

[54] LITHIUM ALLOY CASTING

[75] Inventors: John E. Jacoby; Joseph T. Laemmle; Mei-Yuan Tsai, all of Murrysville, Pa.

[73] Assignee: Aluminum Company of America, Pittsburgh, Pa.

[21] Appl. No.: 679,133

[22] Filed: Dec. 6, 1984

[51] Int. Cl.[4] ..... B22C 3/00

[52] U.S. Cl. ..... 164/72; 72/42; 106/38.22; 106/38.23; 106/38.24; 106/38.25; 164/472; 164/523; 252/56 R; 252/56 S; 260/404.8; 260/410.7

[58] Field of Search ..... 164/72, 472, 523; 72/42; 252/56 R, 56 S; 260/404.8, 410.7; 106/38.22, 38.23, 38.24, 38.25

[56] References Cited

U.S. PATENT DOCUMENTS

| | | | |
|---|---|---|---|
| 3,034,186 | 5/1962 | Holshouser | 22/200.1 |
| 3,253,932 | 5/1966 | White et al. | 106/38.22 |
| 3,381,741 | 5/1968 | Gardner | 164/73 |
| 3,503,770 | 3/1970 | Guillet et al. | 106/270 |
| 3,524,751 | 8/1970 | Smith | 117/5.1 |
| 3,763,244 | 10/1973 | Shubkin | 260/676 R |
| 4,067,817 | 1/1978 | Sturwold | 252/49.3 |
| 4,075,393 | 2/1978 | Sturwold | 252/56 R |
| 4,108,785 | 8/1978 | Sturwold | 252/56 R |
| 4,157,728 | 6/1979 | Mitamura et al. | 164/4 |
| 4,265,663 | 5/1981 | Gilicinski et al. | 106/10 |
| 4,282,392 | 8/1981 | Cupples et al. | 585/10 |
| 4,462,948 | 7/1984 | McClain | 264/140 |

FOREIGN PATENT DOCUMENTS

| | | | |
|---|---|---|---|
| 925070 | 4/1970 | Canada | 253/128 |
| 2129345A | 5/1984 | United Kingdom . | |

*Primary Examiner*—Stephen J. Lechert

*Attorney, Agent, or Firm*—Douglas G. Glantz

[57] ABSTRACT

A process is disclosed for the continuous casting of a lithium-containing alloy including casting the alloy through a mold and applying alpha-olefin oligomer to the mold. In one aspect, the process includes a lubricant containing alpha-olefin oligomer, preferably having a viscosity in the range of about 1-3 cs at 450° F. In another aspect, the process includes a lubricant containing less than the varnish-film forming amount of fatty ester, fatty acid, or fatty alcohol.

20 Claims, No Drawings

LITHIUM ALLOY CASTING

BACKGROUND OF THE INVENTION

This invention relates to the continuous casting of a lithium-containing alloy such as aluminum-lithium alloy.

Conventionally, large ingots of high strength light metal, e.g., such as aluminum, are produced by continuous direct chill casting of molten metal using water as the direct chill coolant. A continuous ingot having a solid surface but a core which is still molten is formed in a water-cooled mold. After passing through the mold, coolant impinges directly on the hot solid ingot surface to provide direct chill cooling. The water then separates and falls from the ingot after extracting heat.

Lithium-containing alloys, such as aluminum-lithium alloys, offer substantial advantages for high technology applications such as aircraft plate, sheet, forgings, and extrusions. Light metal lithium-containing alloys are highly regarded for material properties such as low density, high strength, high modulus of elasticity, and high fracture toughness. The combination of these material properties can reduce the weight of large commercial airliners by as much as six tons or more. The resulting weight savings can reduce an aircraft's fuel consumption by 220,000 gallons or more during a typical year of operation.

A process for continuously casting lithium-containing alloys into acceptable ingots of large size depends on the manner of cooling. Typically, water is used as the direct chill coolant in conventional processes. However, water coming into contact with lithium-containing alloy has been found to present a substantial risk of violent explosion. This risk can be minimized or eliminated through the use of an inventive continuous casting process as described in related U.S. patent application Ser. No. 550,466, filed Nov. 10, 1983.

However, a further problem has been discovered in the continuous casting of lithium-containing alloy which stands in the way of the substantial commercial development of large-scale applications such as large size ingot for aircraft plate and sheet.

INTRODUCTION TO THE INVENTION

It has been found that conventional parting compositions, i.e., mold lubricants, for the continuous casting of molten metal into ingot fail to provide an acceptable lubricant film between the solidifying lithium-containing alloy ingot and the mold surface.

Castor oil is the most commonly used parting composition in the continuous casting of aluminum. Castor oil is identified chemically as the triglyceride of ricinoleic acid (12-hydroxy oleic acid) which accounts for about 80% -85% by weight of commercial castor oil. The remaining portion of castor oil is composed of the mixed triglycerides of oleic, linoleic, and stearic acids. Although castor oil is used as the predominant parting composition of choice in the continuous casting of aluminum with water as the direct chill coolant, it has been found that castor oil fails to perform in casting aluminum-lithium alloy containing more than about 1.5% by weight lithium. Rather, the castor oil used as a parting composition in the continuous casting of lithium-containing alloy produces substantial surface tears in ingots larger than about 6–12 inches in length for 2% lithium by weight and larger than only about 2–3 inches for 3–% lithium by weight.

It is an object of the present invention to provide a parting composition in the continuous casting of a lithium-containing alloy.

It is a further object of the present invention to provide a parting composition which produces a continuous ingot of aluminum-lithium of satisfactory ingot surface characteristics.

It is another object of the present invention to provide a parting composition for the continuous casting of aluminum-lithium alloy capable of performing as a mold lubricant at significantly reduced quantities over conventional prior art mold lubricants.

SUMMARY OF THE INVENTION

The process of the present invention for casting a lithium-containing alloy includes casting the lithium-containing alloy in a mold and applying a parting composition containing alpha-olefin oligomer to the mold. The parting composition contains less than a varnish-film forming amount of fatty ester including triglycerides. The parting composition comprises alpha-olefin oligomer having a viscosity of about 1–3 cs at 450° F.

DETAILED DESCRIPTION

It has been found that parting compositions conventionally used in the continuous casting of aluminum do not produce satisfactory results in casting lithium-containing alloys such as aluminum-lithium alloys containing lithium in an amount of more than 1.5% by weight. Lithium has been found to cleave the ester of conventional parting compositions to produce a lithium soap in a varnish-like film on the mold or header.

The lithium soap occurs according to the following equation:

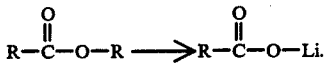

This undesirable reaction occurs with fatty esters including triglycerides, such as castor oil and glycerol trioleate. A similar reaction also occurs with fatty acids. Fatty alcohols and polyols such as pentaerythritol form alkoxides.

The parting composition of the present invention in one aspect contains less than a varnish-film forming amount of compounds detrimentally reactive with aluminum-lithium alloy such as fatty acids, fatty alcohols, and fatty esters including triglycerides. The parting composition preferably contains less than 20% and more preferably less than 5% by weight of compounds which are detrimentally reactive with aluminum-lithium, such as fatty esters, fatty acids, and fatty alcohols. The varnish-like film which forms on the mold produces undesirable tears and bleedouts in the solidified ingot. The most preferred parting composition of the present invention includes a composition substantially free from varnish-film forming amounts of fatty esters, fatty acids, and fatty alcohols. The reaction between these varnish-forming compounds and aluminum-lithium containing more than about 1.5% by weight lithium will occur with as little as 0.1% by weight of the compounds in the parting composition. However, it does not become an insurmountable problem until the amount of varnish-forming compound exceeds a varnish-film forming amount which is detrimental to the ingot surface.

The process of the present invention includes a parting composition containing alpha-olefin oligomer. Alpha-olefin oligomer also is known as iso-paraffinic oligomer or polyalphaolefin. Alpha-olefin oligomer is a synthetic lubricant and a member of the class of twelve major synthetic lubricants, including cycloaliphatics, dialkyl benzene, diesters, halogenated products, phosphate esters, polyalkylene glycols, polyalphaolefins (alpha-olefin oligomers), polybutenes, polyol esters, polyphenol ethers, silicate esters, and silicate fluids. Alpha-olefin oligomers are formed by polymerization, more specifically, oligomerization, according to the following sequence of carefully controlled chemical reactions.

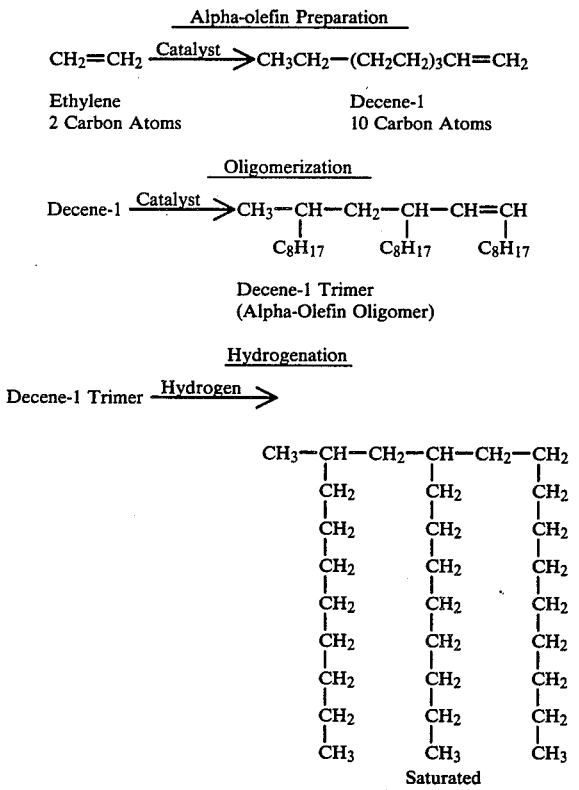

Decene-1 trimer is used here for illustration purposes only, and the alpha-olefin oligomer employed in the present invention includes oligomers having three to ten monomer units of 6–16 carbon atoms. Alpha-olefin oligomers are available commercially from Gulf Oil Company as Synfluid, i.e., under the trade name Synfluid, from Bray Oil Company as PAOL, from Mobil as Mobil SHF, from Emery Industries as Poly-x-olefin, and from Ethyl Corporation.

Our parting composition containing alpha-olefin oligomer preferably is blended to have a viscosity in the range of about 1–3 cs at 450° F. The composition's viscosity at 450° F. is determined by the method published in ASTM D445. Such a preferred parting composition provides a finished ingot surface of acceptable characteristics. Below the 1 centistoke viscosity at 450° F., inadequate lubrication is provided and an inordinate amount of lubricant must be passed over the mold. Above 3 centistokes at 450° F., the composition sets up an undesirable barrier to heat transfer from the molten metal to the mold.

The parting composition of the present invention provides a suitable lubricant film at operating temperatures for the continuous casting of aluminum-lithium alloy. Our parting composition also provides a viscosity low enough at room temperatures so that it can be pumped satisfactorily and distributed in controllable volumes to the mold.

The parting composition of the present invention has acceptable vapor pressure at casting temperatures. The parting composition provides a uniform thickness of lubricant on the mold having a high thermal and oxidative resistance. Most importantly, the parting composition of the present invention provides excellent lubrication to prevent metal sticking or transferring to the mold and to produce a smooth surface to the ingot. Such lubrication has not been found in prior art parting compositions for continuous casting processes. The parting composition of the present invention for the continuous casting of lithium-containing alloys is further described by reference to the following Example.

EXAMPLE

Molten aluminum-lithium alloy at about 1320° F. was fed to a vertical continuous direct chill casting process as described in U.S. patent application Ser. No. 550,466, filed Nov. 10, 1983. The molten metal was formed into an ingot through heat transfer from the molten metal to a mold. A parting composition was applied to the casting surface of the mold to reduce the friction between the moving ingot shell and the mold.

The process used ethylene glycol as the direct chill coolant. The aluminum alloy cast into ingot contained 2% by weight lithium. The casting rate was 3 to 4 inches per minute, and the lubricant flowing rate was 1 milliliter per minute.

The results of various parting compositions are shown in Table I. It was found that castor oil caused casting failure. Substantial tears formed in the ingot surface.

TABLE I

| Parting Composition | Number of Runs | Mold Appearance | Ingot Appearance |
|---|---|---|---|
| Castor Oil | Numerous | Varnish | Substantial tears |
| Glycerol Trioleate | 2 | Varnish | Substantial tears |
| Glycerol Trioleate and Phosphite | 1 | Varnish | Tears |
| Pentaerythritol Ester | 1 | Varnish | Tears |
| Polybutene | 2 | Clear | Small tears |
| Polybutene at increased viscosity | 1 | Clear | Small tears |
| Polybutene and Fatty Alcohol | 1 | Clear | Small tears |
| Present Invention | 7 | Clear | Smooth |

Glycerol trioleate is chemically similar to castor oil but does not contain an hydroxyl group in the molecule. Although showing improvement over castor oil, glycerol trioleate produced substantial tears on the ingot and formed significant varnish on the mold. An analysis of the varnish material found metallic soap formation in the appearance of an hydroxyl functional group.

Phosphite added to the glycerol trioleate showed no improvement over glycerol trioleate. Tears were produced on the ingot and varnish found on the mold.

A more stable ester of pentaerythritol appeared to lubricate better than glycerol trioleate, but produced tears on the ingot and varnish on the mold.

A straight carbon hydrogen compound without any functional group, was tried. Polybutene produced no varnish on the mold but produced small tears on the surface of the ingot. Polybutene having an increased viscosity (about 1 cs at 450° F.) showed no improvement and also produced small tears on the mold. Polybutene having an added film strength additive of fatty alcohol produced no improvement over polybutene.

Alpha-olefin oligomer produced no varnish on the mold and no tears on the ingot surface. Alpha-olefin oligomer mold lubricant produced an aluminum-lithium alloy ingot containing 3% lithium by weight having no tears on the surface of the ingot. The parting composition of alpha-olefin oligomer also permitted a reduction in the amount of lubricant flow to the mold by 60% over castor oil lubricant.

While the invention has been described in terms of preferred embodiments, the claims appended hereto are intended to encompass other embodiments which fall within the spirit of the invention.

What is claimed is:

1. A process for casting a lithium-containing alloy comprising:

casting the lithium-containing alloy through a mold; and applying an alpha-olefin oligomer lubricant to the mold.

2. A process as set forth in claim 1 wherein said lubricant contains less than a varnish-film forming amount of fatty ester.

3. A process as set forth in claim 1 wherein said lubricant contains less than a varnish-film forming amount of fatty acid or fatty alcohol.

4. A process as set forth in claim 1 wherein said lubricant contains less than a varnish-film forming amount of triglyceride.

5. A process as set forth in claim 4 comprising the continuous casting of aluminum-lithium.

6. A process as set forth in claim 5 wherein said aluminum contains lithium in an amount of at least 2% by weight.

7. A process as set forth in claim 6 wherein said alpha-olefin oligomer has a viscosity in the range of about 1–3 cs at 450° F.

8. A process as set forth in claim 7 wherein said lubricant contains a blend of two or more alpha-olefin oligomers.

9. A process as set forth in claim 8 wherein said lubricant contains less than about 20% by weight triglycerides.

10. A process as set forth in claim 9 wherein said lubricant contains less than about 5% by weight triglycerides.

11. A process as set forth in claim 10 wherein said lubricant is substantially free from triglycerides.

12. A process as set forth in claim 11 wherein said aluminum-lithium contains at least 2.0% by weight lithium.

13. A process for continuously casting a lithium-containing alloy, comprising:

casting the lithium-containing alloy through a mold; and lubricating the mold with a lubricant substantially free from triglyceride.

14. A process as set forth in claim 13 wherein said lithium-containing alloy comprises aluminum-lithium having at least 2% by weight lithium.

15. A process as set forth in claim 14 wherein said lubricant contains alpha-olefin oligomer.

16. A process as set forth in claim 15 wherein said alpha-olefin oligomer has a viscosity in the range of about 1–3 cs at 450° F.

17. A process as set forth in claim 16 wherein said alloy contains at least about 2.5% by weight lithium.

18. A process as set forth in claim 17 wherein said alloy contains at least about 3% by weight lithium.

19. A process for the continuous casting of aluminum-lithium alloy containing at least about 2% by weight lithium, comprising:

casting the aluminum-lithium alloy through a mold; and applying to the mold a lubricant containing alpha-olefin oligomer substantially free from triglyceride.

20. A process as set forth in claim 19 wherein the alpha-olefin oligomer has a viscosity in the range of about 1–3 cs at 450° F.

* * * * *

UNITED STATES PATENT AND TRADEMARK OFFICE

CERTIFICATE OF CORRECTION

PATENT NO. : 4,628,985

DATED : December 16, 1986

INVENTOR(S) : John E. Jacoby, Joseph T. Laemmle, Mei-Yuan Tsai

It is certified that error appears in the above-identified patent and that said Letters Patent is hereby corrected as shown below:

Col. 2, line 2 Change "3-⅜" to --3⅜--.

Signed and Sealed this

Seventeenth Day of March, 1987

*Attest:*

DONALD J. QUIGG

*Attesting Officer*

*Commissioner of Patents and Trademarks*